US007181786B2

(12) United States Patent
Schoettle

(10) Patent No.: US 7,181,786 B2
(45) Date of Patent: Feb. 27, 2007

(54) BED COMPROMISING AN AIR GUIDING UNIT FOR AIR-CONDITIONING ROOMS

(76) Inventor: Guenther Schoettle, Im Zimmermann 5, 72202 Nagold (DE)

( * ) Notice: Subject to any disclaimer, the term of this patent is extended or adjusted under 35 U.S.C. 154(b) by 0 days.

(21) Appl. No.: 10/486,525

(22) PCT Filed: Jul. 4, 2002

(86) PCT No.: PCT/EP02/07438

§ 371 (c)(1),
(2), (4) Date: Jun. 26, 2004

(87) PCT Pub. No.: WO03/014630

PCT Pub. Date: Feb. 20, 2003

(65) Prior Publication Data

US 2004/0253920 A1 Dec. 16, 2004

(30) Foreign Application Priority Data

Aug. 10, 2001 (DE) ..... 201 13 291 U
Aug. 10, 2001 (DE) ..... 201 13 292 U

(51) Int. Cl.
*A47C 21/00* (2006.01)

(52) U.S. Cl. ..... 5/421; 5/284; 5/423; 454/187

(58) Field of Classification Search ..... 5/284, 5/421, 423, 724–726; 62/261, 263; 454/187
See application file for complete search history.

(56) References Cited

U.S. PATENT DOCUMENTS

| | | | | |
|---|---|---|---|---|
| 1,142,876 | A * | 6/1915 | Davis et al. | 5/284 |
| 3,266,064 | A * | 8/1966 | Murray | 5/726 |
| 3,601,031 | A * | 8/1971 | Abel et al. | 454/187 |
| 3,928,876 | A * | 12/1975 | Starr | 5/284 |
| 4,218,791 | A * | 8/1980 | Itoku | 5/284 |
| 4,505,328 | A * | 3/1985 | Schmitt | 165/53 |
| 4,667,580 | A * | 5/1987 | Wetzel | 454/187 |
| 4,835,983 | A * | 6/1989 | Chandler et al. | 62/259.1 |
| 5,416,935 | A * | 5/1995 | Nieh | 5/423 |
| 5,887,304 | A * | 3/1999 | von der Heyde | 5/726 |
| 6,336,237 | B1 * | 1/2002 | Schmid | 5/726 |

FOREIGN PATENT DOCUMENTS

| | | |
|---|---|---|
| DE | 86 00 552 | 6/1986 |
| JP | 2000 018638 | 1/2000 |

* cited by examiner

*Primary Examiner*—Michael Trettel
(74) *Attorney, Agent, or Firm*—Jordan and Hamburg LLP

(57) ABSTRACT

The invention being submitted pertains to a bed, consisting of a bedstead (1) and a mattress (2), whereby an air-conduction unit (4) is integrated in the bedstead. Along one or more lateral walls (3) of the bedstead (3), side ducts (6) are provided with lateral escape ports (5) for the out-flow of air from the air-conduction unit (4). Additionally, a mattress air-chamber (10) is provided with the upper escape ports (8) for the discharge of air from the air-conduction unit (4).

18 Claims, 3 Drawing Sheets

BED COMPROMISING AN AIR GUIDING UNIT FOR AIR-CONDITIONING ROOMS

Figure 1:
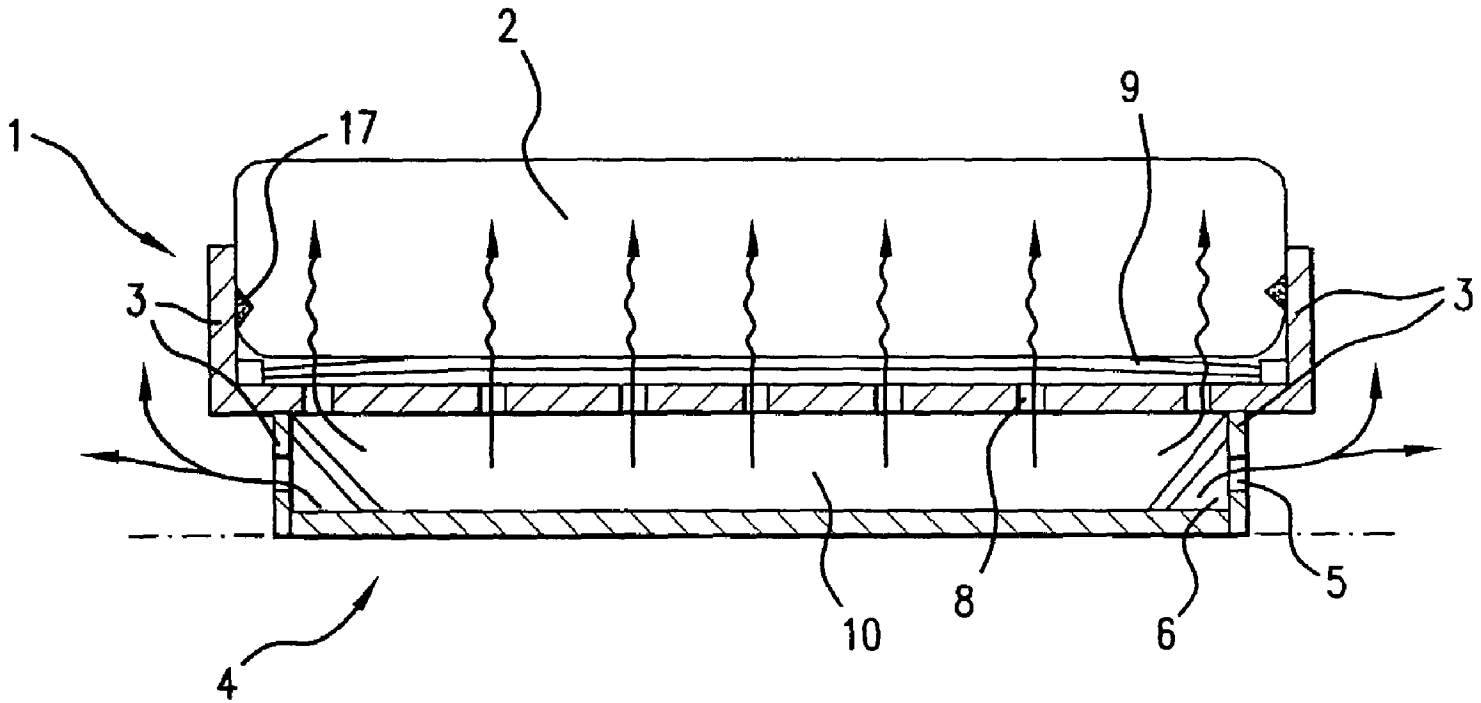

The invention being submitted pertains to air-conditioning devices for rooms, particularly for hotel rooms or hospital rooms.

Air-conditioning appliances with processing systems and air-discharge systems are familiar. Such air-conditioning devices are used particularly in hotel rooms, whereby the outgoing air is being again extracted via the adjacent sanitary block. The disadvantage of many known air-conditioning devices is the high noise generation of the technical systems, as well as the inevitable emergence of draft caused by the air-flow volume and discharge location point, a fact which often prompts guest complaints regarding comfort. Other known air-conditioning devices, that avoid draft-generation, are thermal-inert and react slowly to load deviations, or individual desires for modifications, respectively.

It is hence an objective of the invention being submitted to eliminate the above-indicated disadvantages of known air-conditioning devices. Noise development shall be reduced to a minimum, whereby a sound-intensity level of 20 dB(A) is intended to be achieved in the room. Drafts of any kind will be avoided for the benefit of the hotel guest, and the hygienic conditions for the guest will be improved. At the same time, the equipment installation is intended to be effected quite simply.

This problem will be solved by means of a bed pursuant to Claim 1, a wet-cell pursuant to Claim 25, respectively a room pursuant to Claim 34. The dependent claims pertain to advantageous layouts of the invention.

A central element of the invention is the feeding of air into the hotel room through the required and thereby existent bedstead. Corresponding to the room volumes, the air supply is alternately heated or cooled via lateral outlet orifices located in the bedstead, and thus fed, draft free, into the room, or blown directly over the bed's mattress by means of an integrated switchover mechanism. With the term bedstead side walls, not only bedstead longitudinal walls are thereby meant, but also the walls at the foot-end and/or the head-end. The advantage of the air being supplied over the bed is predominately attributed to the consistency of the air current, so that with little draft emergence and minimal noise generation, a high air supply is possible.

The air supply into the room which flows through the mattress provides the possibility of heating, resp. cooling the mattress via room air-conditioning. Additionally, the mattress can be so dried in order to reduce, resp. eliminate mite formation. If the air supply comes with desinfectant, even the build-up of bacteria in the mattress can be excluded, so that the room conditions are yet suitable for extremely sensitive allergic persons.

In a wet-cell according to the invention, the air-conduction conduits are integrated in the walls and preferably equipped with a noise suppression, so that any generation of noise is reduced to a minimum.

The presented invention will in the following be explained in detail by means of preferred layout—examples of operation with reference to the enclosed drawings.

Figure 2:
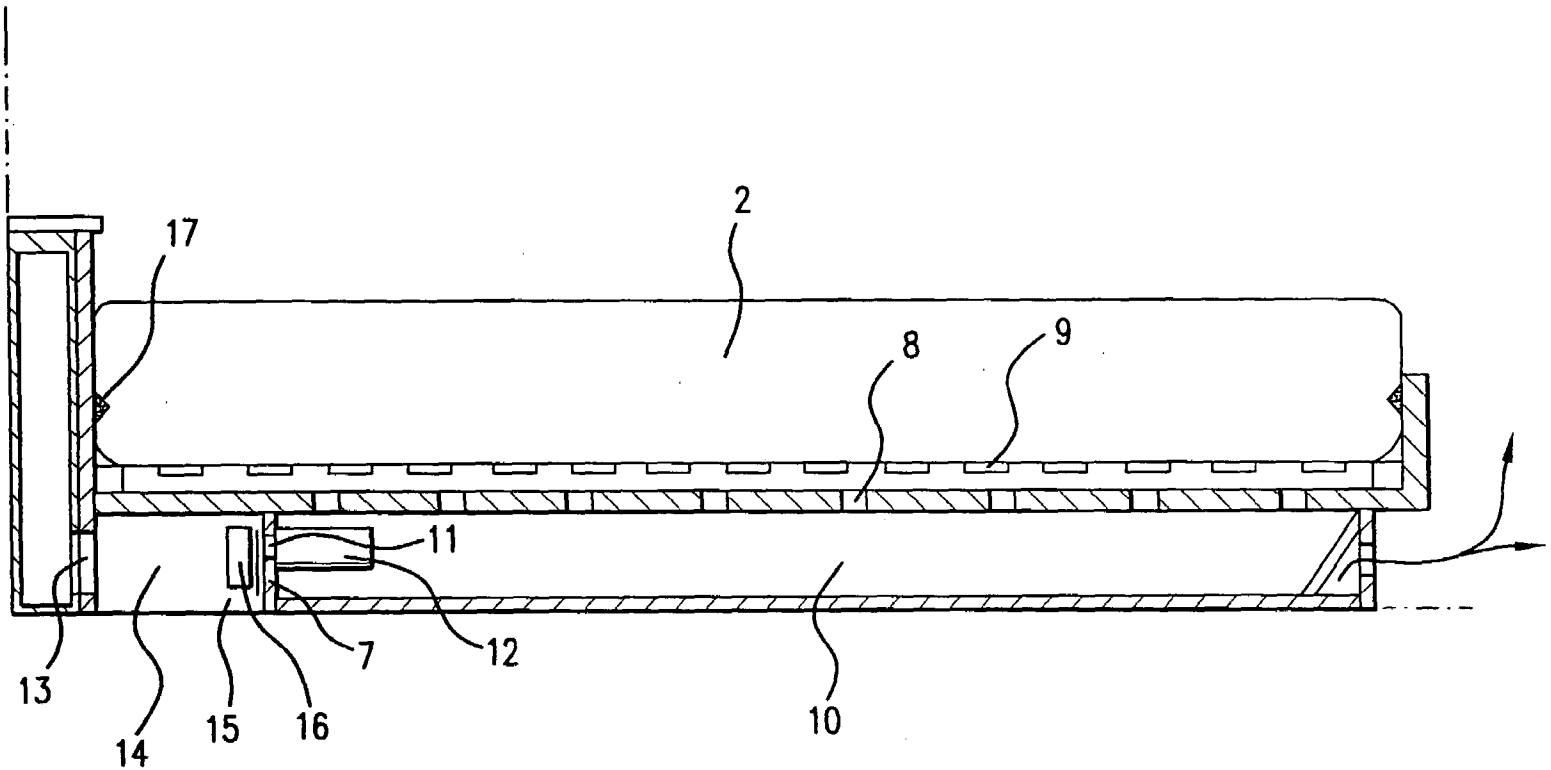
Figure 3:
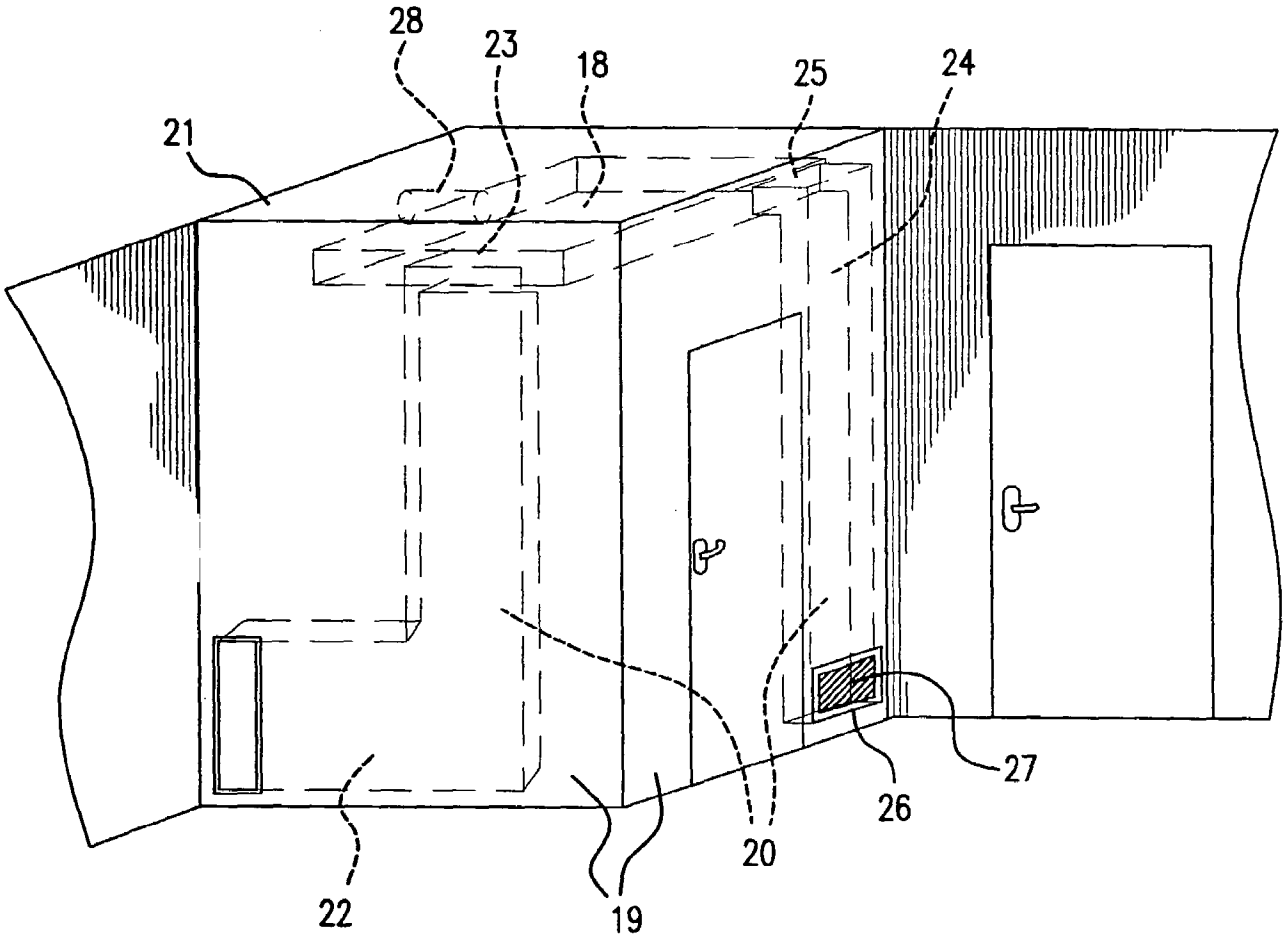

FIG. 1 displays a cross section through a bed with air-conduction unit, according to the invention presented;

FIG. 2 displays an axial section through a bed with air-conduction unit, according to the invention presented; and FIG. 3 displays the arrangement of additional-air ducts in the walls of a wet-cell, according to the invention presented.

FIG. 1 displays a cross section through a bed with bedstead 1 and air-conduction unit 4 according to the invention being submitted. In the bedstead 1, on the lateral walls 3 of the bedstead 1, air-source ducts, resp. side ducts 6 are provided with lateral air-source outlets, resp. lateral escape ports 5, through which draft-free additional air can be fed into the room (air-source operation). Thereby, it is advantageous to utilize special exits, that feature a low impulse.

Furthermore, beneath the mattress 2 and the rack 9, is a mattress air-chamber 10 with additional upper escape ports 8, so that the additional air can be blown directly over the bed's mattress 2 (mattress-airing operation). By means of special shoulder-banding, resp. contact-pressure profiles 17 and the arrangement of the individual jets in a chamber plate, it is being safeguarded that no air loss occurs over the lateral edges of the mattress. For the separation of side airflow, the mattress air-chamber 10 has a chamber plate with adjustable individual jets, resp. distribution rails. As will later be more precisely described, the additional air can either be only laterally blown out of the bedstead 1 via an integrated switchover unit 16, or only over the mattress 2, or both simultaneously.

Preferably intended are the functions: "Room flow air-source operation", "Mattress flow cooling-resp. heating operation", "Mattress-drying operation" and "Mattress-desinfection operation".

In air-source operation, the additional air will be blown off via the lateral escape ports 5. Through the large lateral surface of the bedstead 1, with a relatively high number of escape ports 5, a very consistent room air-flow is obtained. Furthermore, due to a low discharge speed, a minimal noise rate is being achieved at fastest possible heating-, resp. cooling of the room.

With the mattress air-flow function, the cooled-, resp. heated air is blown off over the mattress 2. This can be pleasant for the guest to cool or warm the bed, while sleeping in summer-, or winter periods respectively. For maximum comfort desires, beyond that, provisions exist for pre-warming, resp. pre-cooling the bed.

The air-source operation and the mattress air-flow function can also be run simultaneously. For the person lying on the bed, this has the effect of being supplied—turbulence- and pollution-free—with cooled or slightly warmed air. Absorption of harmful substances via air turbulence is therefore minimized. The results are very good air quality in the laying area. In connection with the mattress air-flow function, maximum air quality is achieved, which is even suitable for allergic persons.

In the drying function for the mattress 2, an airflow through the mattress also takes place. Thereby, the air can be processed, resp. air-flow parameters will be employed, in order to dry the mattress following sleeping periods, preferably during guest's absence. The danger of mite accumulation in the bedding will in this way be reduced, which poses a considerable problem in hotels.

In the mattress-desinfection operation, a mattress flow likewise results. During this process, the air can be treated with a desinfectant in order to desinfect the mattress 2 following its occupancy, preferably in the guest's absence. By doing this, the control of bacteria accumulation in the mattress 2 and other hygienic requirements will be taken into account. Of course, the desinfection operation can also be implemented simultaneously along with the drying operation. For the desinfection operation, a desinfection device can be accommodated in the bedstead, which offers service personnel the possibility to attend to the mattress 2 of the respective bed with regard to aseptic control.

As reflected in FIG. 2, lateral escape ports 5 can also be provided at the bed's foot-end, so that via a total of three exterior sides of the bedstead beneath the bedstead-shoulder, warmed or cooled additional air can be supplied into the room.

The air-feed into a distribution-chamber 14 if effected either from the head section of the bed through a distribution-duct installed in the furniture or in the partition wall, or via special air-discharge outlets integrated in the floor structure. Using adapters, moving of the bed to a certain extent can also be realised. On the bedstead 1 head-end, via a side-duct air-inlet connection 7, the distribution-chamber 14 is combined with the side-ducts and with the mattress air-chamber 10 via a mattress air-chamber-feeding connection 11.

The switchover in the distribution-box is effected via one or several, preferably joint-functioning, sliding flaps 15 for all connections. The various options of the additional-air inlet in the room can thereby be effected alternately. By means of an integrated switchover-unit 16, the additional air can thus either be blown-out merely laterally from the bedstead 1, or only over the mattress, or both simultaneously.

Accordingly, switchover can also be effected between the setting conditions "room flow air-source operation", "mattress flow cooling/heating operation", "mattress desinfection" and "mattress drying". To enhance sleeping comfort, control of the switchover unit can thereby be automatic, but also individual at the guest's desire. The automatic control can thereby be activated through a detection system, that recognizes whether the hotel-room guest is in his room (presence-switching) or absent (absence-switching). Such detection system, that may be fitted into the door area, can, for example, sense whether the guest enters or leaves the room. It is, however, also possible that the switchover be effected via the hotel reception.

FIG. 3, reflects the air-duct system arrangement in the wet-cell walls according to the invention submitted. The wet-cell shows lateral (partition) walls 19 and a ceiling 21. For air conditioning, especially for heating or down-cooling, an air-treatment unit 18 is accommodated in the ceiling 21 to which the air-conditioning conduits 20 are connected. An air-conditioning conduit 20, as additional-air duct 22, is combined with the additional-air escape 23 of the air-treatment unit 18. An air-conditioning conduit 20, depicted as exhaust-air duct 24, is combined with the exhaust-air (intake) outlet 25 of the air-treatment unit 18. Additionally, by means of a connection 28 with an inhouse central system, the air-treatment unit 18 can be connected with air-conditioned primary-air supply. At the intake 26 of the exhaust-air duct 24, an air-filter 27 can be fitted, in order to filter-out the exhaust preceding air treatment.

The special feature of the air conduction within the wet-cell can be noted in the conduction of the additional-air and the exhaust in special, sound-absorbing conduits, which are accommodated in the cavity of the wet-cell walls. With these ducts, the necessary high noise-suppression ratings will be accomplished.

The air-treatment for an air-conditioning facility can be effected, according to the invention submitted, in the ceiling area of the wet-cell or in the ceiling section of the room-access corridor.

The supply of the individual guestroom normally takes place with processed primary-air, which meets requirements of air conditioning, via a conventional central system. The primary-air will be exactly regulated through setting devices (mechanical or electronic volume-flow regulators), precisely lined up in the secondary-air treatment unit, which is preferably located in the wet-cell ceiling area, fed via a primary-air duct.

The primary-air system is always available based upon the possibility of utilization of heat-recovery. An economical supply with sufficiently high exterior-air rate per hotel-room is thus assured.

From the secondary-air treatment unit, via an additional-air duct located in one of the wet-cell walls, the conditioned air will be fed to the bedstead subject to the invention submitted. After the discharge, a portion of the displaced room-air will again be fed to the secondary-air treatment unit. Backflow of the secondary-air occurs in a special exhaust duct located in the wet-cell wall, which warrants both for the entire through-flow of the room as well as the necessary acoustic properties. Filtering of the room-air is effected during this stage of the induction process. This enables convenient maintenance without the intermediate ceiling having to be opened. By means of the special arrangment of the induction, filter exchange can be implemented near the floor in the corridor and thus without having to open the ceiling in the wet area. Another portion of the displaced room-air is conventionally extracted from the wet-cell via an exhaust duct (not shown), and blown out through the roof.

The reduction of heat-attenuation ratings of the wall between guestroom and wet-cell to be anticipated, due to installation of the air-conditioning conduits 20 in the wet-cell partition walls 19, will in one way be accounted for by duct attenuation and also through the special heavy, rubber-mat casing outside the additional-air duct. Aside of the additional air-side noise attenuation, this arrangement simultaneously effects the heat insulation in both heating- and cooling operation. The air-treatment device can be designed as special sound-absorption construction with interchangeable connector box, so that all conceivable connection options are possible.

The air-conditioning system pursuant to the invention can be constructed as an integral functional principle, whereby technical function and design of all components enable their coordination with one another. The aggregate advantages of the individual components become fully effective only in the composite structure of all components.

The wet-cell with integrated air-processing unit, resp. air-treatment unit 18, can be supplied completely pre-installed, including ready-wired electric sub-distribution and pre-installed room-air system with special acoustic silencing, which gains additional muffling through laying the air feeding and discharge ducts in the partition wall of the wet-cell. This yields a substantial reduction of installation period and failure sources. Another advantage is that all components can be factory checked and acceptance-tested. Likewise, it is possible to deliver the air-conduction-, or bed air-discharge systems respectively, in prefabricated condition. The subject system pursuant to invention is therefore particularly suitable for restauration purposes.

The secondary-air processing unit, or the secondary-treatment device respectively, for the individual room unit consists of a complete acoustically decoupled unit, which is integrated, ceiling-flush, in the upper section of the wet-cell or in the door area next to the wet-cell. The unit serves for heating and cooling and is being additionally supplied via a primary-air connection with processed exterior air from the central system. Based upon the excellent noise attenuation and the particular in- and outflow conditions, higher delivery pressures can be achieved, which, among other things, are used to also install the circulating-air operation filter (class F5) in the room. The secondary-air processing unit, or the secondary-treatment device respectively, is subdivided into several performance sizes and can be both installed, prefabricated in the wet-cell, as well as without wet-cell, set-up in the corridor.

REFERENCE LIST OF DESCRIPTIVE TERMS

1 Bedstead
2 Mattress
3 Lateral walls
4 Air-conduction unit
5 Lateral escape ports
6 Side ducts
7 Side-duct feeding connection
8 Upper escape ports
9 Mattress-rack
10 Mattress air-chamber
11 Mattress air-chamber feeding connection
12 Desinfection unit
13 Additional-air connection
14 Distribution-chamber
15 Sliding flaps
16 Control unit, resp. switchover unit
17 Contact-pressure profile
18 Air-treatment unit
19 Partition walls
20 Air-conditioning conduits
21 Ceiling
22 Additional-air duct
23 Additional-air escape
24 Exhaust-air duct
25 Exhaust-air intake
26 Intake
27 Air-filter
28 Connection The invention of claimed is:

1. Bed comprised of a bedstead and a mattress, wherein the bedstead has side-walls and comprises an air-conduction unit and the air-conduction unit comprises the side-walls, the side-walls having openings therethrough for the passage of air, said openings comprise escape ports in the side-walls for lateral outflow of air out of the bedstead from the air-conduction unit, further comprising:

side-ducts in the air-conduction unit, the side-ducts being comprised of the side-walls having escape-ports; and an air-chamber formed in the bedstead, the air-chamber communicating with upper escape ports; and a side-duct feeding connection for feeding air into the side-ducts, means sealing the side-ducts so that the air fed thereto can escape only through said escape ports; and a mattress-rack for supporting the mattress and, beneath the mattress rack, a topside having upper escape ports for the passage of air; and means sealing the air-chamber so that air therefrom can escape only through said upper escape ports; and further comprising an additional air connection for communication between a source of conditioned air and the side-ducts and/or the air-chamber.

2. Bed according to claim 1, further comprising a disinfectant dispenser for dispensing disinfectant into the air-chamber.

3. Bed according to claim 1, further comprising means separating and sealing the air-chamber from the side-ducts.

4. Bed according to claim 1, wherein the bedstead further comprises a distribution-chamber and feed-lines communicating between the distribution-chamber and the side-ducts and the air-chamber.

5. Bed according to claim 1, further comprising at least one sliding flap for selectively blocking communication between the distribution-chamber and the side-ducts and the air-chamber.

6. Bed according to claim 1, further comprising at least one chamber-plate in the air-chamber, the chamber-plates having adjustable individual jets or distribution-bars.

7. Bed according to claim 1, further comprising a switchover unit which alternately opens and/or closes communication between the distribution-chamber and the side-ducts and the air-chamber.

8. Bed according to claim 1, further comprising means for detecting presence of a person in a room in which the bed is located and for controlling the switchover unit by signaling said presence of a person.

9. Bed according to claim 1, further comprising a manual switch for operating the switchover unit.

10. Bed according to claim 1, further comprising additional bedstead walls sealingly engaging at least a portion of a periphery of the mattress.

11. Bed according to claim 1, wherein at least some of the escape ports comprise nozzles.

12. Bed according to claim 1, in combination wit a source of conditioned air, the conditioned are being cooled or warmed.

13. Bad according to claim 12, wherein the source of conditioned air is accommodated in the distribution-chambers.

14. Bed according to claim 1, further comprising means for connecting the additional air-connection to a central air cooling and/or heating system.

15. Bed according to claim 1, wherein the mattress is air-permeable.

16. Bed according to claim 1, further comprising conduits integrated into the mattress for conducting air from the upper escape ports only vertically into the mattress.

17. Bed according to claim 1, wherein the mattress is of a honeycomb structure.

18. A wet-cell installation for a room, comprising;

partition walls and a ceiling and an air-treatment unit contained in the installation and air-conditioning ducts mounted in flue walls and communicating with the air-treatment unit, said air-treatment unit is mounted in the ceiling; and means for sensing room-air temperature and, in response thereto, controlling the air-treatment unit, said air-treatment unit further comprises means for dispensing disinfectant into air being treated; and an additional air duct adapted to supply conditioned fresh-air from the air-treatment unit to an air-connection of a receiver of the conditioned fresh-air;

said wet-cell installation in combination with a bed comprising a bedstead and a mattress, the bedstead comprising an air-chamber and air-ducts and including said air-connection, said air-connection communicating with the bedstead air-chambers and air-ducts.

* * * * *